United States Patent [19]

Jiang

[11] Patent Number: 4,736,483

[45] Date of Patent: Apr. 12, 1988

[54] DUSTER HOLDER SIMULTANEOUSLY DECORATED WITH DUSTER FEATHER

[76] Inventor: I. Sheng Jiang, P. O. Box 10160, Taipei, Taiwan

[21] Appl. No.: 23,249

[22] Filed: Mar. 9, 1987

[51] Int. Cl.[4] ..... A47L 13/38

[52] U.S. Cl. ..... 15/234; 15/104 R; 206/361; 206/457

[58] Field of Search ..... 15/104 A, 104 R, 234; 206/361 X, 362, 362.1, 362.2, 362.3, 457 X; D6/553, 554; D32/52; 248/110; 211/65

[56] References Cited

U.S. PATENT DOCUMENTS

| | | | |
|---|---|---|---|
| 17,085 | 8/1901 | Mackay | 248/110 |
| 51,364 | 10/1917 | Condé | D6/554 |
| 2,177,504 | 10/1939 | Thompson | 206/361 |

*Primary Examiner*—Harvey C. Hornsby
*Assistant Examiner*—Corinne M. Reinckens

[57] ABSTRACT

A duster holder includes a base board, an overlying board shorter than the base board fixed on the upper portion of the base board, a receptacle formed on the lowest edge of the base board, and a duster inserted in between the overlying board and the base board having feathers protruding from several openings or windows formed on the overlying board to mimic the hat, skirt and other decorative accessories of a human or animal figure printed on the overlying board and base board to thereby form a duster holder for holding the duster therein and also simultaneously enhancing a three-dimensional decorative function of the figures as effected by the duster feathers.

5 Claims, 2 Drawing Sheets

DUSTER HOLDER SIMULTANEOUSLY DECORATED WITH DUSTER FEATHER

BACKGROUND OF THE INVENTION

A conventional duster is always made of feather or artificial plumage assembled on a handle, which when hanged on a wall is lacking of decorative meaning and will influence the esthetic feature of the interior upholstery.

The present inventor has found this phenomenum and invented the present duster holder also having decorative effect as reflected by the duster.

SUMMARY OF THE INVENTION

The object of the present invention is to provide a duster holder including a base board printed with leg portions of a human figure on its middle portion, an overlying board formed on the upper portion of the base board and printed with a head and a body portion of the human figure and cut with several openings or windows thereon, a duster jacketed within the overlying board as fixed on the base board and a receptacle formed on the lowest edge of the base board adapted to receive the duster handle, to thereby form a holder for holding a duster therein and also becoming a three-dimensional human figure as effected by the duster feathers protruding outwardly from the openings or windows of the overlying board.

DETAILED DESCRIPTION

Figure 1:
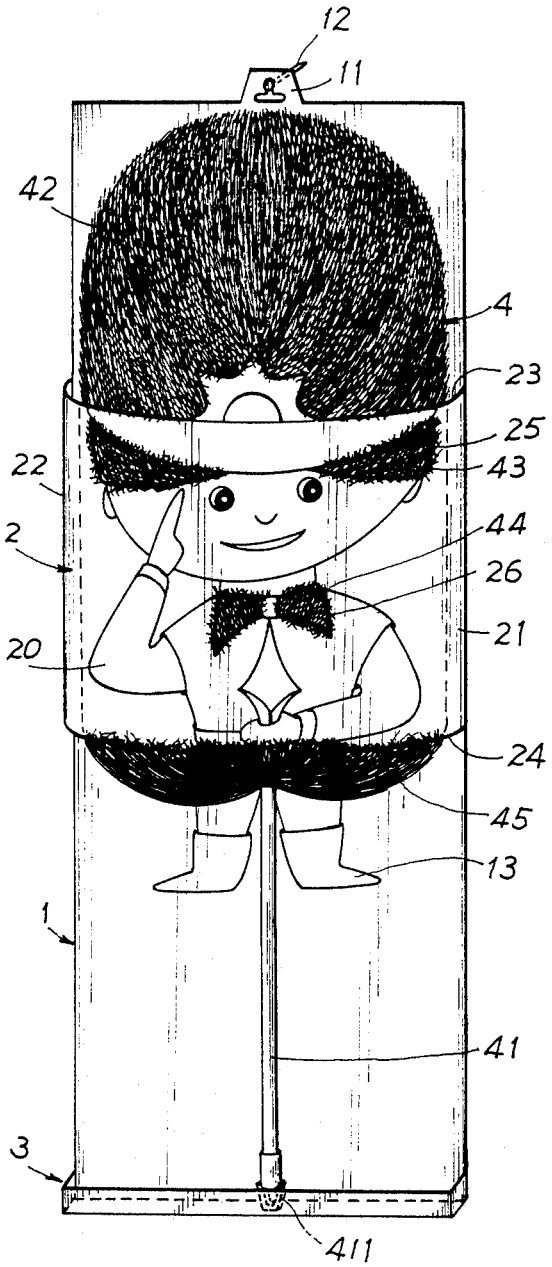
FIG. 1 is a perspective view of the present invention.
Figure 2:
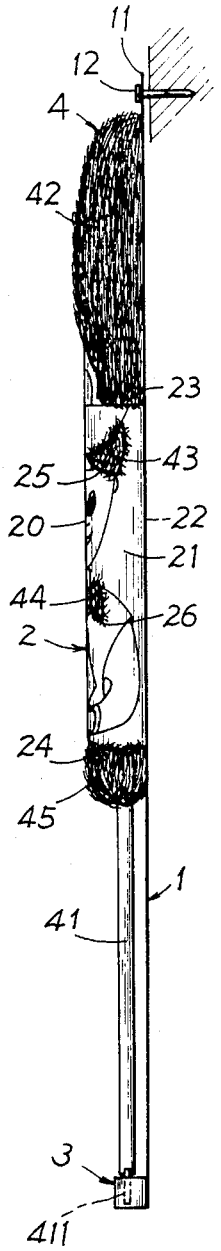
FIG. 2 is a side view illustration of FIG. 1.
Figure 3:
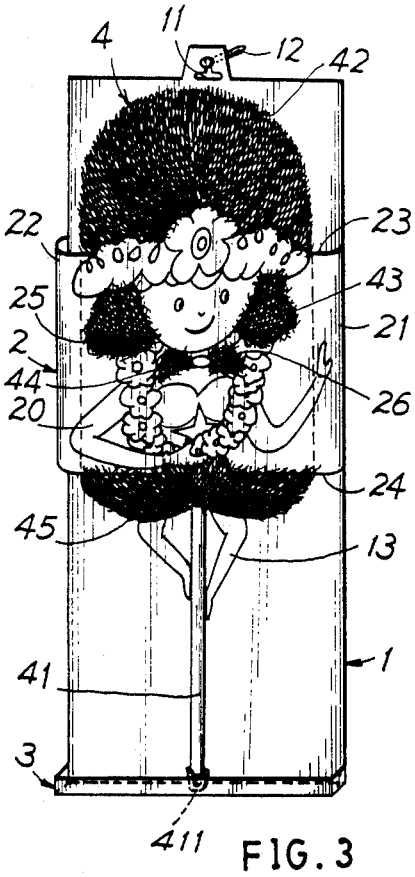
FIG. 3 shows another preferred embodiment of the present invention.

As shown in FIGS. 1–4, the present invention comprises: a base board 1, an overlying board 2, a duster 4 and a duster receptacle 3.

The base board 1 may be made of paper or other suitable materials and includes a bracket 11 on the top edge of board 1 for fixing the board on a wall by a nail 12, and a pair of leg portions 13 of a humman figure printed on the middle portion positioned under the overlying board 2. The duster receptacle 3 is fixed on the lowest edge of the board 1 and may by formed as a generally rectangular socket adapted to receive or stop a handle 41 of the duster 4.

The overlying board 2, also preferably made of paper, includes: a head and body portion 20 of a human figure printed thereon; two longitudinal side edges 21, 22 respectively fixed on two longitudinal edges on the upper portion of the base board 1 to form a jacket adapted for the insertion of the duster 4 therethrough; two transverse edges, an upper edge 23 and a lower edge 24, respectively formed on the two transverse edges of the board 2 across the two longitudinal side edges of the base board to define an upper opening and a lower opening with the base board 1 for the free insertion or passing of the duster therethrough; at least an upper window 25 formed on the upper portion of the overlying board 2 to reveal an upper feather 43 when inserting the duster 4 between the board 2 and board 1 to mimic the hair of the human figure 20; and a middle window 26 formed on the middle portion of the board 2 to reveal the middle feather 44 of the duster 4 to mimic a decorative accessory such as necktie or the like of the human FIG. 20.

The human FIG. 20 can be chosen as a soldier, a girl dancer, a clown, an indian, a magician or other interesting or ornamental figures. Naturally, other animal figures (not shown) can be printed on the boards 1, 2 to modify the aforementioned human figures. The number and shapes of windows 25, 26 are not limited in this invention and can be suitably modified by those skilled in the art. The length or height of the overlying board 2 should be shorter than that of the base board 1.

The duster 4 is formed with colorful feathers or artificial plumage on a handle 41. The top feather 42 may serve to mimic a hat of the human FIG. 20 and the lower feather 45 serve to mimic a skirt of the leg portions 13 of the human figure and also a decorative accessory for a stick such as a spear (FIG. 1) or a star rod (FIG. 3) as simultaneously demonstrated by the handle 41 of the duster 4.

Figure 4:
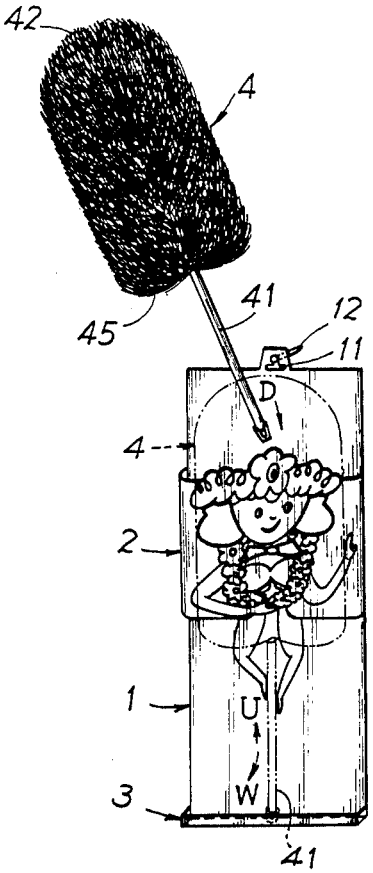
FIG. 4 shows an application of the present invention when holding a duster in the holder or removing the same.

When using the present invention as shown in FIG. 4, the duster 4 with its handle 41 is jacketed in between the board 2 and the board 1 to be held and limited by the lower receptacle 3 as shown in dotted line (direction D). When it is necessary to use the duster for cleaning purpose, the handle 41 of duster 4 is raised in direction U to leave from the holding receptacle 3 and then withdrawn in direction W to remove the duster 4 from the holder of this invention for practical use.

Figure 5:
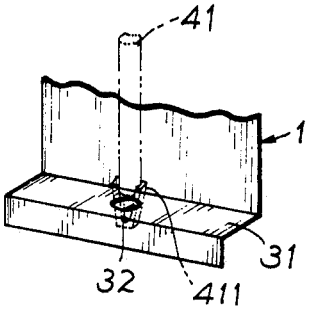
FIG. 5 shows another preferred socket for the duster of the present invention.
Figure 6:
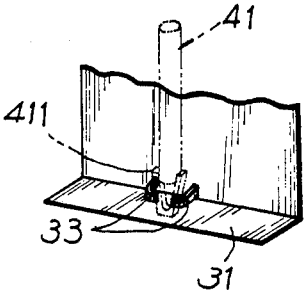
FIG. 6 shows still another preferred socket for the duster of the present invention.

The receptacle 3 can be modified to be an extension 31 formed on the lowest edge of the board 1 and formed with a central hole 32 adapted to hold the tapered tip 411 of the duster handle 41 (FIG. 5). Still, a clamping device 33 is formed near the extension 31 of the receptacle 3 for holding the handle 41 of the duster 4 as shown in FIG. 6.

The present invention has the following advantages superior to conventional dusters:

1. The duster holder having several windows to reveal the duster feather to mimic the hair or necktie of a human figure and several openings to protrude feather to mimic top hat and lower skirt of the figure to increase the three dimentional decorative effect of the paper boards so that the duster can be held in the holder and can also auxiliarily enhance the ornamental effect of the holder.

2. The duster can be easily conveniently inserted in between the two boards 2, 1 or freely withdrawn therefrom either upwardly or downwardly through the openings 23, 24 of the board 2 overlain on the board 1, for quicker take-out and insertion application of the duster 4.

I claim:

1. A duster holder simultaneously decorated with duster feathers comprising:

a base board having a bracket formed on its top edge adapted to be fixed on a wall and a pair of leg portions of a human figure printed on a middle portion of said base board;

a duster having colorful feathers or artificial plumage assembled on a handle of which a lower tapered tip of said duster handle is received and limited by a receptacle formed on a lowest edge of said base board;

an overlying board printed with a head and body of a human figure including two longitudinal side edges fixed on two longitudinal side edges on an upper portion of said base board, an upper edge and a lower edge respectively formed on two transverse edges of said overlying board across the two longitudinal side edges of said base board to define two openings each formed between said overlying board and said base board adapted for the free insertion of said duster therethrough, at least an upper window formed on the upper portion of said overlying board adapted to reveal an upper feather portion of said duster to mimic the hair or the human figure, a middle window formed on the middle portion of said overlying board adatped to reveal a middle feather portion of said duster to mimic a decorative accessory such as a necktie of the human figure;

said duster having a top feather portion protruding from the upper transverse edge across the two longitudinal side edges of said overlying board to mimic a hat of said human figure printed on said overlain board, and having a lower feather portion protruding from the lower transverse edge across the two longitudinal side edges of said overlying board to mimic a skirt of said human figure and also a decorative accessory of a stick such as a spear of a soldier, said stick being simultaneously demonstrated by said handle of said duster.

2. A duster holder according to claim 1, wherein said overlying board has a height shorter than that of said base board, said leg portions of said human figure printed on said base board being positioned under said lower edge of said overlying board.

3. A duster holder according to claim 1, wherein said receptacle formed on the lowest edge of said base board is formed as a generally rectangular socket adapted to receive said duster handle.

4. A duster holder according to claim 1 wherein said receptacle is formed as an extension having a hole formed thereon to limit the lower tip of said duster handle.

5. A duster holder according to claim 1, wherein said receptacle includes a clamping device formed near said extension to hold said duster handle.

* * * * *